US011234573B1

(12) United States Patent
Hangyu

(10) Patent No.: US 11,234,573 B1
(45) Date of Patent: Feb. 1, 2022

(54) WATER TANK FOR CLEANING EQUIPMENT AND CLEANING EQUIPMENT THEREOF

(71) Applicant: Keewoo Robotics Technology Co., Ltd., Shenzhen (CN)

(72) Inventor: Wu Hangyu, Shenzhen (CN)

(73) Assignee: Keewoo Robotics Technology Co., Ltd., Baoan District (CN)

( * ) Notice: Subject to any disclaimer, the term of this patent is extended or adjusted under 35 U.S.C. 154(b) by 0 days.

(21) Appl. No.: 17/334,986

(22) Filed: May 31, 2021

Related U.S. Application Data

(63) Continuation-in-part of application No. 17/090,767, filed on Nov. 5, 2020, now Pat. No. 11,019,976.

(30) Foreign Application Priority Data

Sep. 30, 2020 (CN) ..... 202011058746.X
Mar. 15, 2021 (CN) ..... 202110277181.2

(51) Int. Cl.
*A47L 11/40* (2006.01)
*A47L 11/30* (2006.01)

(52) U.S. Cl.
CPC ..... *A47L 11/4016* (2013.01); *A47L 11/30* (2013.01); *A47L 11/4027* (2013.01)

(58) Field of Classification Search
CPC ... A47L 11/4016; A47L 11/30; A47L 11/4027
See application file for complete search history.

(56) References Cited

U.S. PATENT DOCUMENTS 6,948,211 B2 * 9/2005 Stephens ..... A47L 5/28 15/326

* cited by examiner

*Primary Examiner* — Andrew A Horton
(74) *Attorney, Agent, or Firm* — Cooper Legal Group, LLC

(57) ABSTRACT

The present disclosure relates to a water tank structure and a vacuum cleaner. The water tank structure includes a tank body and a tank cover assembly. The tank body has an accommodation cavity therein, and an end of the tank body is formed with an opening in communication with the accommodation cavity. The tank cover assembly includes a cover body and at least one flow divider, and the cover body is disposed at an end of the tank body proximate to the opening. The flow divider is in communication with the cover body and the accommodation cavity. The flow divider is configured to divide a fluid stream flowing therethrough into a plurality of fluid streams formed into pairs having paired kinetic energies carried thereby and paired opposing flow directions, such that the kinetic energies of the pairs of fluid streams cancel out.

23 Claims, 5 Drawing Sheets

WATER TANK FOR CLEANING EQUIPMENT AND CLEANING EQUIPMENT THEREOF

CROSS-REFERENCE TO RELATED APPLICATION

The present application is a continuation-in-part of U.S. patent application Ser. No. 17/090,767, filed Nov. 5, 2020, which claims priority to Chinese Patent Application 202011058746.X, filed on Sep. 30, 2020. The present application also claims priority to Chinese Patent Application 202110277181.2, filed on Mar. 15, 2021. U.S. patent application Ser. No. 17/090,767, Chinese Patent Application 202011058746.X, and Chinese Patent Application 202110277181.2 are incorporated herein by reference.

TECHNICAL FIELD

The present disclosure relates to the technical field of cleaning apparatuses and in particular to a water tank structure for cleaning equipment and to cleaning equipment.

BACKGROUND

As one of the important parts of a wet vacuum cleaner, a wastewater tank is mainly used to collect the sucked-up wastewater and garbage. A suction port of the existing wastewater tank is usually opened at a bottom of the wastewater tank and is arranged to define a columnar structure protruding into the wastewater tank. As a result of the above design, airflow in the wastewater tank easily agitates the wastewater, causing the wastewater in the wastewater tank to be sucked into the motor. Due to the above, not only will the motor be damaged, but wastewater will also be blown to the outside of the wet vacuum cleaner.

SUMMARY

An objective of embodiments of the present disclosure is to solve the following technical problem in which wastewater in the wastewater tank is sucked into the motor and to provide a water tank structure for cleaning equipment and cleaning equipment.

In order to solve the aforementioned technical problems, an embodiment of the present disclosure provides a water tank structure using the following technical solution.

a wastewater tank structure for cleaning equipment, comprising:

a wastewater tank; and a first flow channel and a second flow channel, provided with the wastewater tank, both connecting through an inside portion and an outside portion of the wastewater tank, wherein the first flow channel divides a fluid stream flowing to the wastewater tank into multiple fluid streams to make the multiple fluid streams collide in the wastewater tank, and the second flow channel discharges air in the wastewater tank out.

As a further improvement to the aforementioned technical solution, the first flow channel defines at least two dividing outlets distributed at intervals.

As a further improvement to the aforementioned technical solution, the wastewater tank comprises a tank body and a tank cover, the tank body defines an accommodation cavity and a first opening at one terminal of the tank body connecting with the accommodation cavity, the tank cover is disposed at another terminal of the tank body close to the first opening, and the first flow channel and the second flow channel are provided on an end portion of the tank body close to the first opening or on the tank cover.

As a further improvement to the aforementioned technical solution, the first flow channel defines at least two dividing outlets, and the at least two dividing outlets of the first flow channel are distributed towards a side wall of the tank body.

As a further improvement to the aforementioned technical solution, an inlet of the second flow channel is distributed towards a side wall of the tank body.

As a further improvement to the aforementioned technical solution, the first flow channel defines at least two dividing outlets, and a first distance between an inlet of the second flow channel and a bottom of the accommodation cavity is longer than a second distance between the at least two dividing outlets of the first flow channel and the bottom of the accommodation cavity.

As a further improvement to the aforementioned technical solution, a side wall of the tank cover close to the bottom of the accommodation cavity is an inclined plane with a high portion and a low portion, the second flow channel is disposed at the high portion and the first flow channel is disposed at the low portion.

As a further improvement to the aforementioned technical solution, the first flow channel defines at least two dividing outlets, and an inlet of the second flow channel and the at least two dividing outlets of the first flow channel are staggered.

As a further improvement to the aforementioned technical solution, the tank cover defines a second opening and a third opening, a dividing portion protruding toward an inside of the accommodation cavity and an exhausting portion are both disposed on the tank cover, the first flow channel is opened at the dividing portion and connected with the second opening, and the second flow channel is opened at the exhausting portion and connected with the third opening.

As a further improvement to the aforementioned technical solution, the exhausting portion and the dividing portion are distributed at two side of an axis of the tank body, and the inlet of the second flow channel is opened at a wall of the exhausting portion away from the dividing portion and towards a direction different from a direction of the at least two dividing outlets of the first flow channel.

As a further improvement to the aforementioned technical solution, the dividing portion comprises a baffle disposed at a bottom of the second opening, the first flow channel is defined between the baffle and the second opening, and at least one terminal of the baffle is connected with the tank cover or the exhausting portion.

As a further improvement to the aforementioned technical solution, one terminal of the baffle extends in a direction away from the inlet of the second flow channel.

As a further improvement to the aforementioned technical solution, the one terminal of the baffle bends and protrudes towards the second opening, the baffle is bent about an axis, and the at least two dividing outlets of the first flow channel are opened at one end of the dividing portion distributed from one end of the baffle to another end of the baffle.

As a further improvement to the aforementioned technical solution, the exhausting portion is configured as a shell structure, and an inner chamber of the exhausting portion defines the second flow channel and covers the third opening.

As a further improvement to the aforementioned technical solution, an inner wall of the tank body is smooth and flat.

In order to solve the aforementioned technical problems, an embodiment of the present disclosure further provides a wastewater tank structure, and the wastewater structure comprises a filter assembly disposed on the wastewater tank for filtering the air exhausted from an outlet of the second flow channel.

As a further improvement to the aforementioned technical solution, an outflow chamber corresponding to the outlet of the second flow channel is defined on the wastewater tank, the filter assembly comprises a stand and a filter, the stand is disposed on the wastewater tank and defines a hollow portion corresponding to the outflow chamber, and the filter is disposed on the hollow portion.

As a further improvement to the aforementioned technical solution, an outer wall of the wastewater tank defines a container for containing a connecting pipe of the cleaning equipment.

In order to solve the aforementioned technical problems, an embodiment of the present disclosure further provides a wastewater tank structure, and the wastewater structure comprises a tank body, defining an opening connecting with an accommodation cavity of the tank body at one terminal of the tank body; a tank cover disposed at the one terminal of the tank body close to the opening; and a first flow channel defined on the tank cover or the one terminal of the tank body close to the tank cover, wherein the first flow channel divides a fluid stream flowing into a wastewater tank into multiple fluid streams to make the multiple fluid streams collide with each other in the wastewater tank.

During the process of operating the water tank structure for cleaning equipment and the cleaning equipment above, the first flow channel of the wastewater tank divides a fluid stream flowing to the wastewater tank into multiple fluid streams to make the multiple fluid streams collide in the wastewater tank. After the fluid stream with sewage and garbage is divided into multiple fluid streams though the first flow channel, due to the weight differences between the incorporated air and the sewage garbage in each fluid stream, the incorporated air and the sewage garbage are speared during flowing down into the wastewater tank.

During the above separation process, each fluid stream of air-incorporated sewage and garbage collides with each other so as to make the kinetic energy of each fluid stream of air-incorporated sewage and garbage respectively reduced, cancelled out, or at least cancelled out in part by the above collision, which makes the suction producing device more easily suck the separated air away through the second flow channel to prevent the separated air from continuing to fall down and mix with sewage and garbage to agitate the sewage and garbage. The above implementation effectively prevents the sewage and garbage in the wastewater tank from being sucked into the suction producing device as well. Thereby, it not only prevents relating damage to the suction producing device, but also prevent the sewage and garbage from being blown to the outside of the cleaning equipment so as to improve the space utilization ratio of the wastewater tank.

Therefore, compared with the conventional operation mode that emphasizes improving the flow energy of rotating air, the embodiments of the present disclosure reduce the kinetic energy of the disturbed fluid stream in the wastewater tank, so that the sewage and garbage in the wastewater tank are not easily sucked into the motor, thereby reducing the probability of motor damage.

BRIEF DESCRIPTION OF THE DRAWINGS

To illustrate the solutions in the present disclosure more clearly, the drawings to be used in the description of the embodiments will be introduced briefly as follows. It is apparent that the drawings in the following description are merely some embodiments of the present disclosure. For those of ordinary skill in the art, other drawings can be obtained according to these drawings without any inventive efforts. In the drawings.

DETAILED DESCRIPTION OF THE EMBODIMENTS

Figure 1:
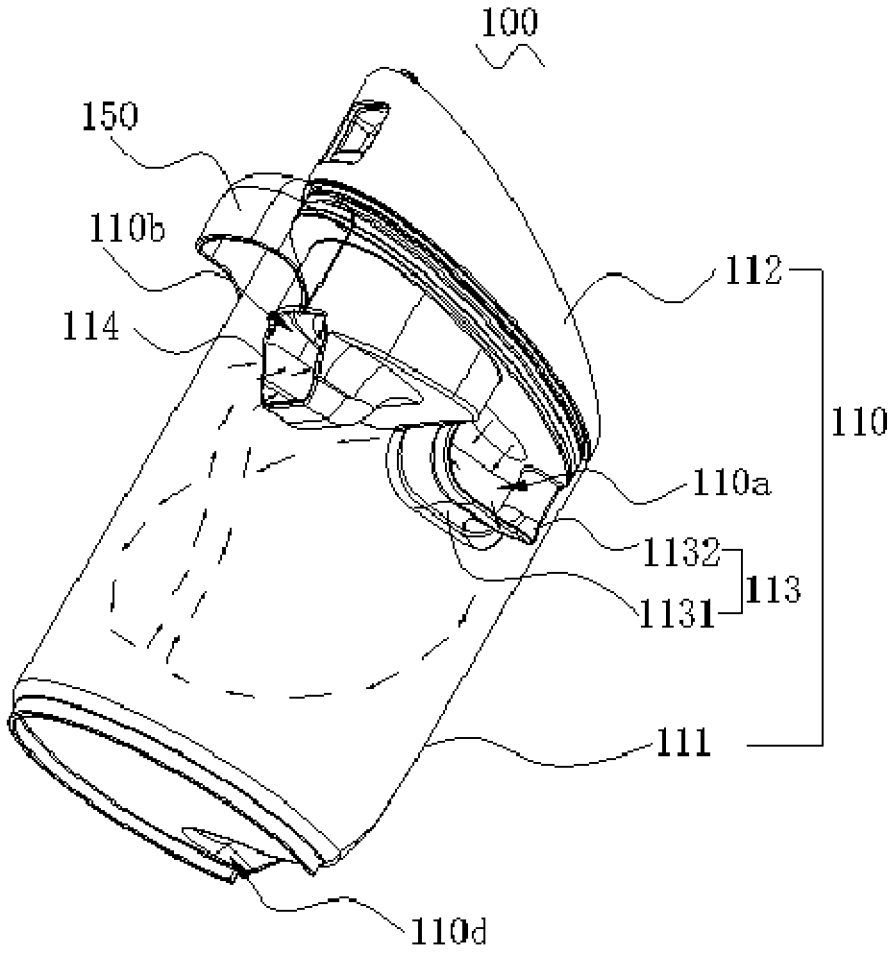
FIG. 1 is a schematic diagram of the structure of a wastewater tank for cleaning equipment according to an embodiment of the present disclosure.

Unless defined otherwise, all of the technical and scientific terms used herein have the same meanings as those usually understood by those of ordinary skill in the art in the technical field of the present disclosure. The terms used in the specification herein are merely intended to describe specific embodiments and are not intended to limit the present disclosure. For example, directions or positions indicated by terms such as "length," "width," "up," "down," "left," "right," "front," "rear," "vertical," "horizontal," "top," "bottom," "in", and "out" are directions and positions shown on the basis of the drawing. These terms are merely for ease of description and cannot be construed as a limitation to the technical solution.

Terms "include" and "have" and any variations thereof in the description, claims, and the brief description of the drawings of the present disclosure are intended to cover non-exclusive inclusion. Terms such as "first" and "second" in the description and claims or the brief description of the drawings of the present disclosure are used to distinguish between different objects and are not used to describe a specific sequence. In the description, claims, and the brief description of the drawings of the present disclosure, when an element is described as being "fixed on" or "mounted on" or "disposed on" or "connected to" another element, the element can be directly or indirectly located on the other element. For example, when an element is described as being "connected to" another element, the element can be directly or indirectly connected to the other element.

In addition, when an "embodiment" is referred to herein, it means that specific features, structures, or characteristics described with reference to the embodiment can be included in at least one embodiment of the present disclosure. When used in different locations in the description, this term does not necessarily refer to the same embodiment and does not refer to an independent or alternative embodiment mutually exclusive to other embodiments. Those skilled in the art explicitly and implicitly understand that the embodiments described herein can be combined with other embodiments.

Figure 2:
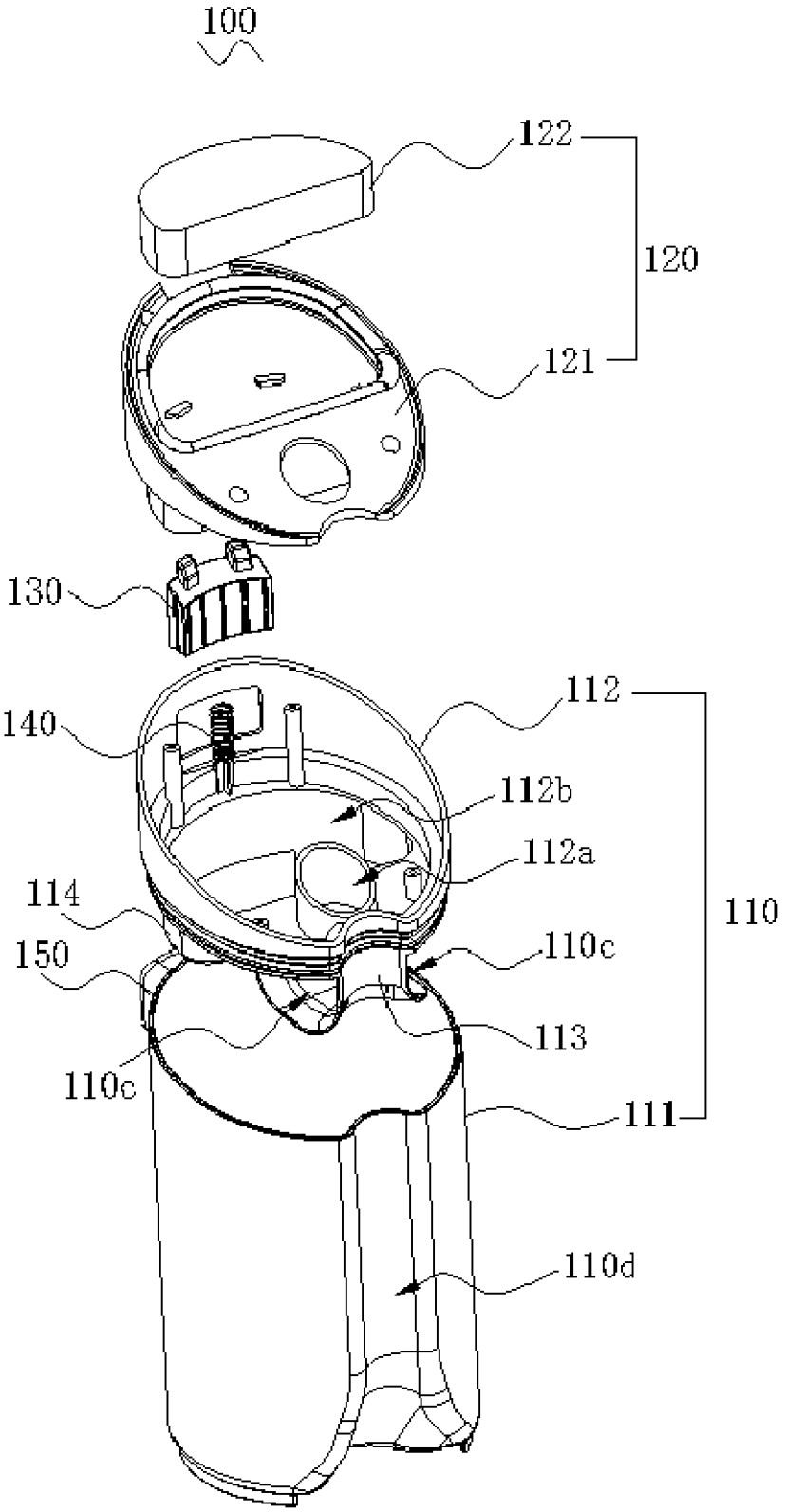
FIG. 2 is an exploded perspective view of a wastewater tank structure for cleaning equipment according to an embodiment of the present disclosure.

One embodiment of the present application disclosures a wastewater tank structure 100 for cleaning equipment. As shown in FIG. 1 and FIG. 2, the wastewater tank structure 100 includes a wastewater tank 110, and a first flow channel

110*a* and a second flow channel 110*b* are provided with the wastewater tank 110. The first flow channel 110*a* and the second flow channel 110*b* are both connected through the inside and outside portions of the wastewater tank 110. The first flow channel 110*a* is used to divide a fluid stream flowing to the wastewater tank 110 into multiple fluid streams, so as to make the multiple fluid stream collide in the wastewater tank 110. The second flow channel 110*b* is used to discharge air that is in the wastewater tank 110 out of the wastewater tank 110.

Figure 3:
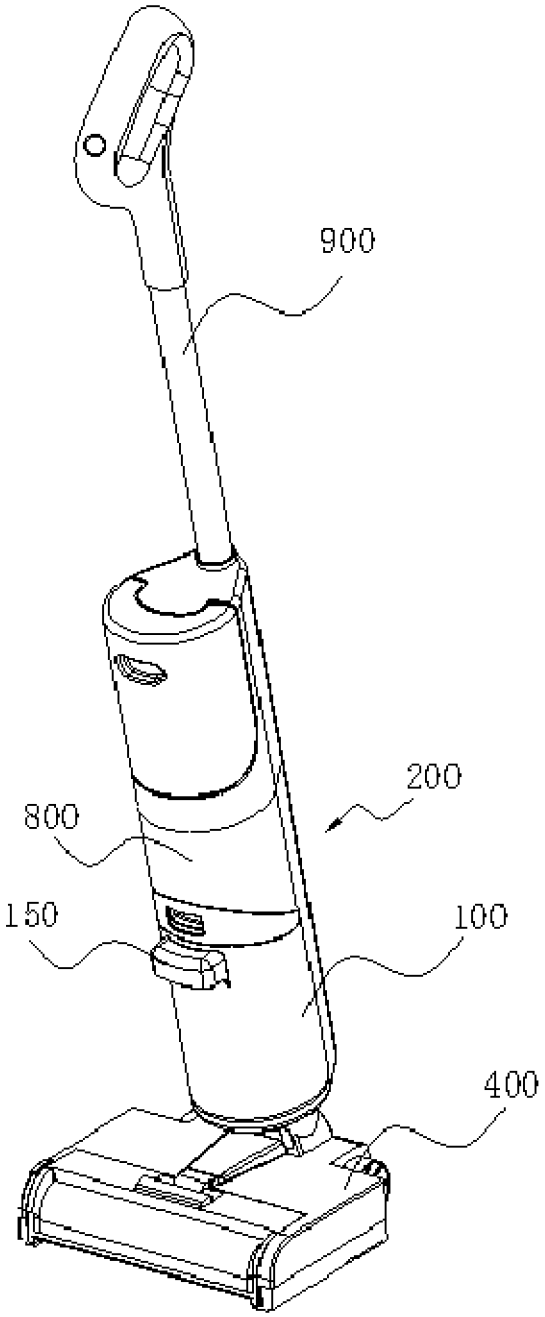
FIG. 3 is a schematic diagram of cleaning equipment according to an embodiment of the present disclosure.
Figure 4:
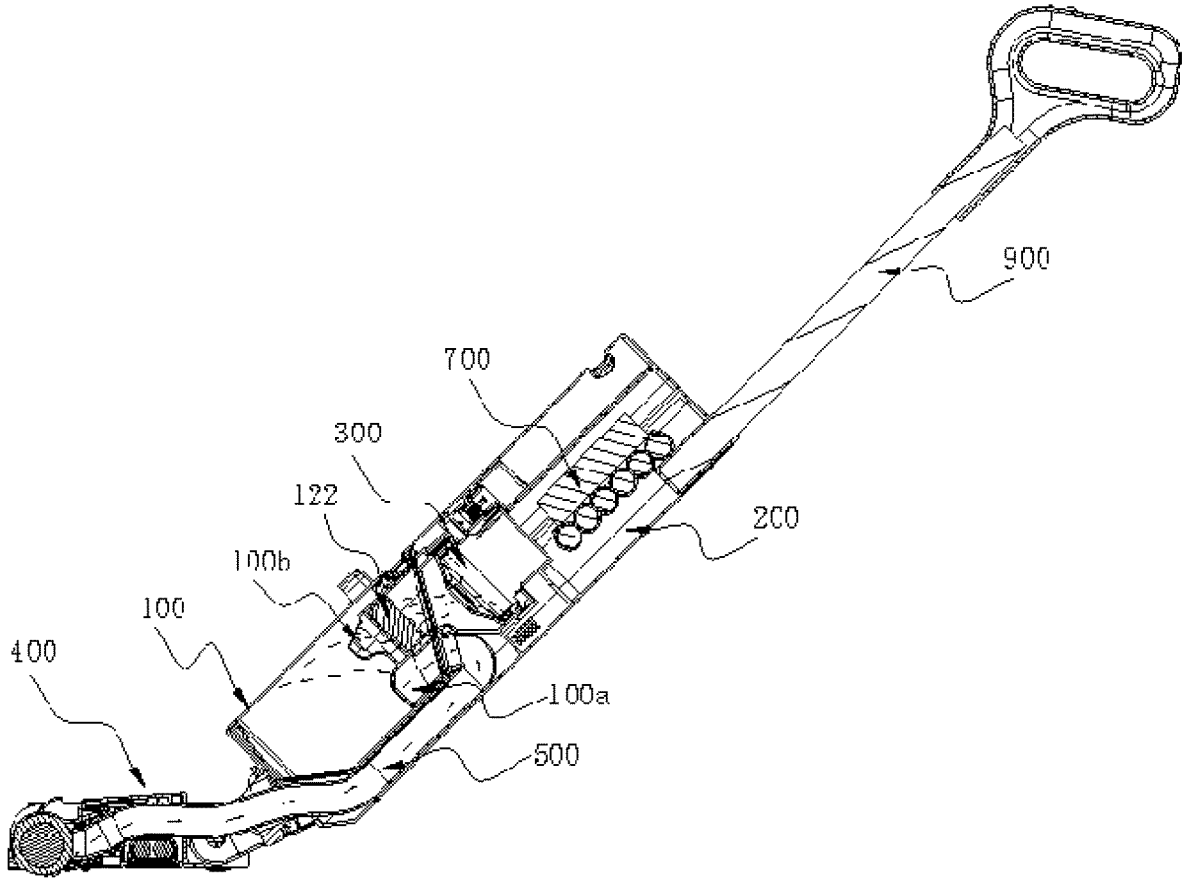
FIG. 4 is a cross-sectional view of cleaning equipment in a working state according to an embodiment of the present disclosure.
Figure 5:
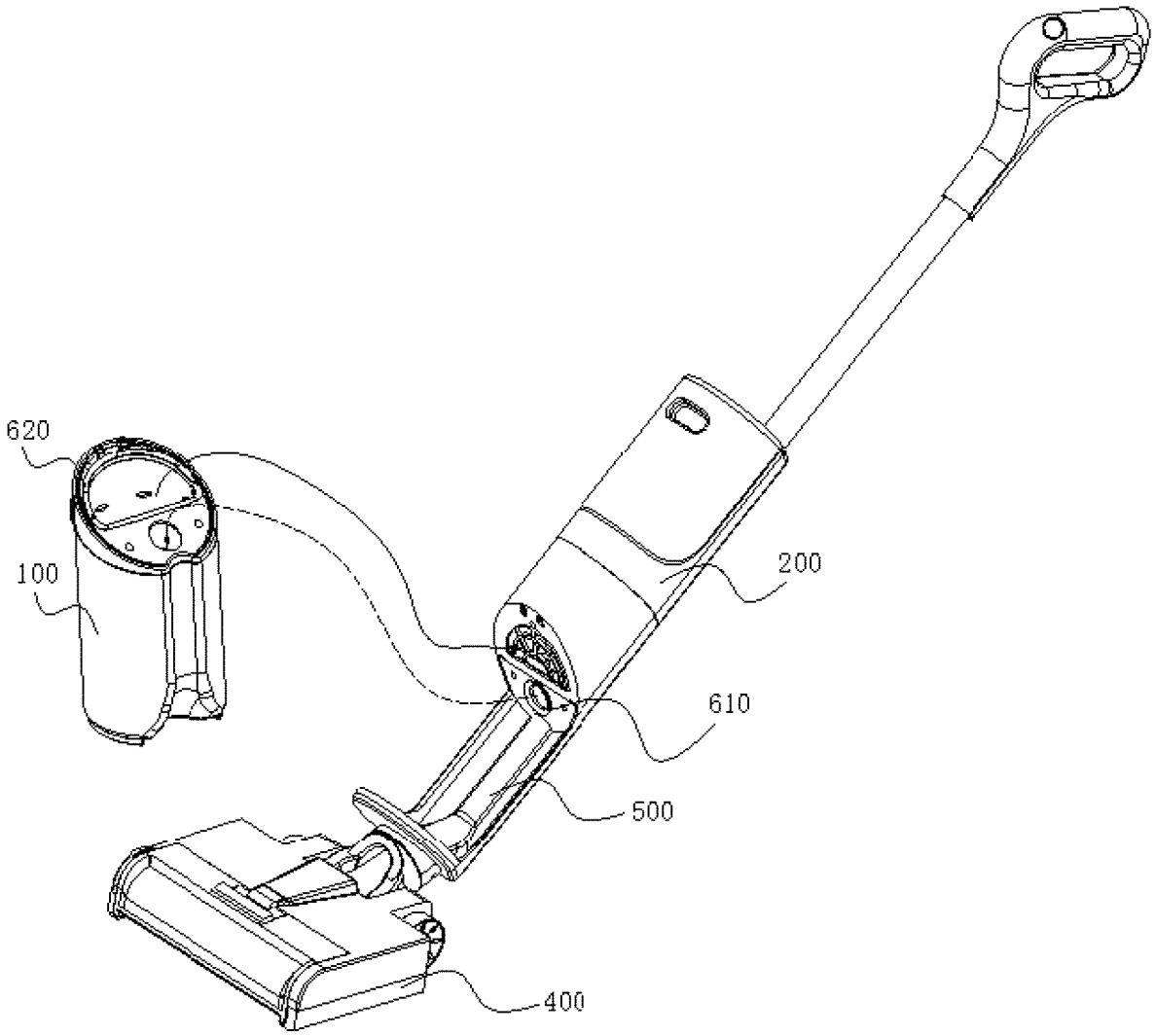
FIG. 5 is a schematic diagram of an assembly between the wastewater tank structure and a machine body of cleaning equipment according to an embodiment of the present disclosure.

It should be noted that both the first flow channel 110*a* and the second flow channel 110*b* of the wastewater tank 110 have an inlet and an outlet, respectively. The wastewater tank structure 100 is able to be disposed on a machine body 200 of cleaning equipment (for example, a wet vacuum cleaner). As an example, as shown in FIGS. 3 to 5, the cleaning equipment includes the machine body 200, a suction producing device 300 disposed on the machine body 200, a floor brush 400, and a connecting pipe 500. The connecting pipe 500 has a first terminal and second terminal oppositely configured with each other. The first terminal is connected to the floor brush 400, and the second terminal is connected to the inlet of the first flow channel 110*a* of the wastewater tank 110 of the wastewater tank structure 100. A suction opening of the suction producing device 300 is connected to the outlet of the second flow channel 110*b* of the wastewater tank 110.

It should be noted that the arrows in FIG. 4, except for marking labels, are used to indicate a flow direction of fluid. The dashed arrows in FIG. 5 are used to indicate the flow direction of sewage (i.e., wastewater) and garbage mixed with air. The solid arrow, except for marking labels, is used to indicate the flow direction of the air.

When the cleaning equipment is used to clean a ground surface, the suction producing device 300 works to generate vacuum suction to suck the wastewater and garbage on the ground into the inlet of the first flow channel 110*a* of the wastewater tank structure 100 through the connecting pipe 500. The air-incorporated sewage and garbage flows into the wastewater tank 110 through the first flow channel 110*a* after being divided into multiple fluid streams. While each fluid stream of air-incorporated sewage and garbage flows down into the wastewater tank 110, due to weight differences between the incorporated air and the sewage and garbage, the incorporated air and the sewage and garbage are separated. Furthermore, during the above separation process, each fluid stream of air-incorporated sewage and garbage collides with each other so as to make the kinetic energy of each fluid stream of air-incorporated sewage and garbage respectively smaller, cancelled out, or at least cancelled out in part due to the above collisions.

Thereby, the air-incorporated sewage and garbage flows into the wastewater tank 110 more smoothly and fluently and the separated air in one fluid stream collides with the air in other fluid streams in the wastewater tank structure 100 so as to reduce its own kinetic energy, enabling the suction producing device 300 to more easily suck the separated air away through the second flow channel 100*b* to prevent the separated air from continuing to fall down and mix with sewage and garbage to agitate the sewage and garbage, which can effectively prevent the sewage and garbage in the wastewater tank 110 from being sucked into the suction producing device 300. The above implementation of the present embodiment not only prevents related damage to the suction producing device 300, but also prevents the sewage and garbage from being blown to the outside of the cleaning equipment so as to improve the space utilization ratio of the wastewater tank 110.

The wastewater tank structure 100 described above is able to be applied to cleaning equipment. The first flow channel 110*a* of the wastewater tank 110 divides the fluid stream flowing into the wastewater tank 110 into multiple fluid streams and makes the air in the multiple fluid streams collide with each other in the wastewater tank 110. After the air-incorporated sewage and garbage is divided into multiple fluid steams through the first flow channel 110*a*, each fluid stream of air-incorporated sewage and garbage undergoes an air-liquid separation process during the downward flow into the wastewater tank 110. During the air-liquid separation process, every fluid stream of the air-incorporated sewage and garbage collides with each other in the wastewater tank 110, so that the kinetic energy of each fluid stream of the air-incorporated sewage and garbage is reduced, cancelled out, or at least cancelled out in part due to the above collisions. Therefore, the sewage and garbage is able to flow into the wastewater tank 110 more smoothly and fluently.

The separated air collides with the air of other fluid streams in the wastewater tank structure 100, thus reducing its own kinetic energy, enabling the suction producing device 300 to more easily suck the separated air away through the second flow channel 110*b* to prevent the separated air from continuing to fall down and mix with sewage and garbage to agitate the sewage and garbage, which can effectively prevent the sewage and garbage in the wastewater tank 110 from being sucked into the suction producing device 300. The above implementation not only prevents damage to the suction producing device 300, but also prevents the sewage and garbage from being blown to the outside of the cleaning equipment.

Compared with conventional designs, in general, which emphasize power by increasing the flow energy of rotating air, the present embodiment reduces the kinetic energy of the disturbed fluid stream in the wastewater tank structure 100, so that the sewage and garbage in the wastewater tank structure 100 are not easily sucked into the suction producing device 300, thereby reducing the probability of damage to the suction producing device 300.

In some embodiments of the present disclosure, as shown in FIG. 2, the first flow channel 110*a* has at least two dividing outlets 110*c* distributed at intervals. In this way, sewage and garbage are able to be effectively divided. Regarding the number of dividing outlets 110*c* disclosed, the embodiment of the present disclosure does not impose specific restrictions. The number can be an even number, such as 2, 4, or 6, as shown in FIG. 2, and of course, can also be an odd number, such as 3, 5, 7, etc.

Certainly, in some other embodiments of the present disclosure, the number of the dividing outlets 110*c* of the first flow channel 110*a* can also be one, and the direction of the dividing outlets 110*c* is distributed around itself. This situation can be regarded as the first flow channel 110*a* being provided with a plurality of dividing outlets 110*c* along its own circumferential direction, and two adjacent dividing outlets 110*c* are next to each other.

In some embodiments of the present disclosure, as shown in FIGS. 1 and 2, the wastewater tank 110 includes a tank body 111 and a tank cover 112. The tank body 111 has an accommodation cavity, and one terminal of the tank body 111 has a first opening connecting with the accommodation cavity. The tank cover 112 is disposed on the terminal of the tank body 111 close to the first opening. The first flow channel 110*a* and the second flow channel 110*b* are opened on an end portion of the tank body 111 close to the first opening or on the tank cover 112. The tank cover 112 is detachably disposed relative to the tank body 111 so that the tank body 111 is able to be cleaned after being detached from the tank cover 112.

In some embodiments, as shown in FIG. 2, the dividing outlets 110*c* of the first flow channel 110*a* are distributed towards a side wall of the tank body 111. This configuration inhibits the air-incorporated sewage and garbage from flowing straight to a bottom of the accommodation cavity of the tank body 111 after the air-incorporated sewage and garbage flows out from the dividing outlets 110*c* of the first flow channel 110*a*, which avoids surging of liquid level in the tank body 111 and effectively prevents sewage and garbage from being blown away by the air and carried into the suction producing device 300 or brought to the outside environment. Moreover, this configuration also causes the air-incorporated sewage and garbage to hit the side wall of the tank body 111 after the air-incorporated sewage and garbage flows out from the dividing outlets 110*c* of the first flow channel 110*a*, which not only improves the separation effect between air and sewage and garbage, but also makes the separated air hit the side wall of the tank body 111 and turn again to produce an opposing cyclone air stream so as to effectively suppress the kinetic energy of the air in the tank body 111.

In some embodiments, as shown in FIG. 1, the inlet of the second flow channel 110*b* is distributed towards the side wall of the tank body 111. Therefore, this configuration prevents a surge of sewage and garbage in the tank body 111 from entering into the inlet of the second flow channel 110*b* and prevents the sewage and garbage from being blown to the outside of the cleaning equipment so as to improve the space utilization ratio of the wastewater tank 110.

Under the condition that the wastewater tank 110 includes the tank body 111 and the tank cover 112, as shown in the FIG. 1 and FIG. 2, in one embodiment of the present disclosure, a first distance between the inlet of the second flow channel 110*b* and the bottom of the accommodation cavity is longer than a second distance between the dividing outlets 110*c* of the first flow channel 110*a* and the bottom of the accommodation cavity. As the cleaning equipment is in the process of cleaning the ground, sewage and garbage will be stored in the accommodation cavity of the tank body 111, and the movement of the cleaning equipment will cause a surge of the sewage stored in the tank body 111. By increasing the first distance between the inlet of the second flow channel 110*b* and the bottom of the accommodation cavity, the effect of inhibiting surges from entering the inlet of the second flow channel 100*b* is better and thereby the space utilization ratio of the wastewater tank 110 is improved.

Specifically, in one embodiment of the present disclosure, as shown in FIG. 1 and FIG. 2, a side wall of the tank cover 112 close to the bottom of the accommodation cavity is an inclined plane with a high portion and a low portion. The second flow channel 110*b* is disposed at the high portion of the inclined plane, and the first flow channel 110*a* is disposed at the low portion of the inclined plane. By setting the second flow channel 110*b* to be disposed at the high portion of the inclined plane, the inlet of the second flow channel 100*b* is as far away as possible from the bottom of the tank body 111 in a limited space arrangement.

Under the condition that the wastewater tank 110 includes the tank body 111 and the tank cover 112, as shown in the FIG. 1 and FIG. 2, in one embodiment of the present disclosure, the inlet of the second flow channel 110*b* and the dividing outlets 110*c* of the first flow channel 110*a* are staggered. Therefore, the above arrangement avoids the fluid streams flowing out of the dividing outlets 110*c* of the first flow channel 110*a* from directly flowing out from the inlet of the second flow channel 110*b*.

Specifically, in one embodiment of the present disclosure, as shown in FIG. 2, the tank cover 112 defines a second opening 112*a* and a third opening 112*b*. A dividing portion 113 protruding toward the inside of the accommodation cavity and an exhausting portion 114 are both disposed on the tank cover 112. The first flow channel 110*a* is opened at the dividing portion 113 and connected with the second opening 112*a*, and the second flow channel 110*b* is opened at the exhausting portion 114 and connected with the third opening 112*b*. Thereby, the first flow channel 110*a* and the second flow channel 110*b* are directly disposed on the tank cover 112 without enlarging the thickness of the tank cover 112. Understandably, the inlet of the first flow channel 110*a* is connected with the second opening 112*a* of the tank cover 112 and the outlet of the first flow channel 110*a* is connected with the inside of the accommodation cavity of the tank body 111. Furthermore, the inlet of the second flow channel 110*b* is connected with an inner chamber of the tank body 111, and the outlet of the second flow channel 110*b* is connected with the third opening 112*b* of the tank cover 112.

In some embodiments, as shown in FIG. 1 and FIG. 2, the inner wall of the tank body 111 is smooth and flat. There is no additional structure disposed inside of the tank body 111. Therefore, compared with the columnar structure protruding into the wastewater tank in conventional designs, the amount of sewage and garbage that can be contained in the wastewater tank 110, in one embodiment of the present disclosure, is able to be increased to prevent users from frequently emptying the wastewater tank 110 during use, which makes the wastewater tank 110 easy to use and shortens the cleaning process time.

In some embodiments, the dividing portion 113 and the exhausting portion 114 are able to be connected to the tank cover 112 in an integrated manner.

In some embodiments, the exhausting portion 114 and the dividing portion 113 are distributed at two different sides of an axis of the tank body 111, and the inlet of the second flow channel 110*b* is opened at a wall of the exhausting portion 114 away from the dividing portion 113 and towards a direction different from the direction of the dividing outlets 110*c* of the first flow channel 110*a*. With the above arrangement, the length of the flowing path of the air separated from the sewage and garbage in the tank body 111 is increased so as to extend the collision period between the air and air in other fluid streams, which is able to effectively suppress the kinetic energy of the air.

Specifically, in one embodiment of the present disclosure, as shown in FIG. 1, the dividing portion 113 comprises a baffle 1131 disposed at the bottom of the second opening 112*a*. The first flow channel 110*a* is defined between the baffle 1131 and the second opening 112*a*, and at least one terminal of the baffle 1131 is connected with the tank cover 112 or the exhausting portion 114. Garbage mixed with sewage hits the baffle 1131 of the dividing portion 113 through the second opening 112*a* of the tank cover 112 to offset part of the kinetic energy of the garbage mixed with sewage. After that, the garbage and sewage with reduced kinetic energy flow towards different terminals of the baffle 1131 under the operation of the suction producing device 300 so as to realize dividing of fluid streams. In addition, the baffle 1131 can also block the sewage and garbage in the wastewater tank 110 from flowing out from the first flow channel 110*a* to the outside of the wastewater tank 110.

In some embodiments, the baffle 1131 has a "L" shape, and a vertical section of the baffle 1131 is connected with the tank cover 112. In one embodiment of the present disclosure, the baffle 1131 has an "l" shape, and one end of the baffle 1131 is connected to the exhausting portion 114.

In some embodiments, as shown in FIG. 1, one terminal of the baffle 1131 extends in a direction away from the second flow channel 110*b*. One terminal of the baffle 1131 bends and protrudes towards the second opening 112*a*, and the dividing outlets 110*c* of the first flow channel 110*a* are opened at one end of the dividing portion 113 extending along the baffle from one end (terminal) of the baffle 1131 to another end of the baffle 1131. Therefore, after the suction producing device 300 stops working, the residual sewage and garbage sucked into the first flow channel 110*a* can flow diagonally downward by virtue of its own gravity through the dividing portion 113 of the above type of structure. In addition, the dividing portion 113 includes an install plate 1132, and the install plate 1132 is connected between the baffle 1131 and the tank cover 112. Certainly, in another embodiment of the present disclosure, one end of the baffle 1131 is able to be extended to fit the side wall of the tank body 111.

Specifically, in some embodiments of the present disclosure, the exhausting portion 114 is configured as a shell structure, and an internal chamber of the exhausting portion 114 constructs the second flow channel 110*b* and covers the third opening 112*b*. The exhausting portion 114 of this type of structure is easy to manufacture and also easy to install at the third opening 112*b* of the tank cover 112.

In one embodiment of the present disclosure, as shown in FIG. 2, the wastewater tank structure 100 includes a filter assembly 120 disposed on the wastewater tank 110 for filtering air exhausted from the outlet of the second flow channel 110*b*. The air separated from sewage and garbage is discharged through the second flow channel 110*b* and then filtered through the filter assembly 120 again. With the above arrangement, wastewater tank structure 100 is able to purify the air and further effectively avoid the sewage or garbage contained in the air from being carried out through the air. Therefore, the aforementioned structure prevents the exhausted air from blocking the suction producing device 300 due to the carried impurities with the air and avoids damage to the suction producing device 300 thereby.

Additionally, in one embodiment of the present disclosure, an outflow chamber corresponding to the outlet of the second flow channel 110*b* is defined on the wastewater tank 110. As shown in FIG. 1, the filter assembly 120 comprises a stand 121 and a filter 122. The stand 121 is disposed on the wastewater tank 110 and defines a hollow portion corresponding to the outflow chamber. The stand 121 with the hollow portion is able to steadily carry the filter 122 and prevents the filter 122 from detaching from the stand 121. Additionally, it is convenient for the air flowing out of the second flow channel 110*b* to pass through the hollow portion of the stand 121 and be further filtered by the filter 122 before being discharged to the external environment.

In some embodiments, the filter 122 can be a filter sponge, which has the advantages of good elasticity, high filtration efficiency, low air resistance, repeated washing with water, and low cost and is able to effectively filter air. Moreover, in one embodiment of the present disclosure, the shape of the filter 122 is regular and an outer wall of the filter 122 is smooth and round, which facilitates the cleaning of the filter 122 and the tank cover 112. For example, the shape of the filter 122 is a semicircular shape, and correspondingly, the hollow portion of the stand 121 is also a semicircular shape.

In one embodiment of the present disclosure, as shown in FIG. 1 and FIG. 2, an outer wall of the wastewater tank 110 defines a container 110*d* for containing the connecting pipe 500 of the cleaning equipment. The container 110*d* enables the connecting pipe 500 to fit the tank body 111 and extends into the top of the tank body 111, which can improve the compactness of the entire cleaning equipment.

The wastewater tank structure 100 for cleaning equipment is provided in some embodiments of the present disclosure. As shown in FIG. 1 and FIG. 2, the wastewater tank structure 100 includes the tank body 111 and the tank cover 112. The tank body 111 defines an opening connecting with the accommodation cavity of the tank body 111 at one terminal of the tank body 111, and the tank cover 112 is disposed at one terminal of the tank body 111 close to the opening. The first flow channel 110*a* is defined on a top portion of the tank cover 112 or at one terminal of the tank body 111 close to the tank cover 112, dividing a fluid stream flowing into the tank body 111 into multiple fluid streams that collide with each other in the tank body 111.

The wastewater tank structure 100 described above is able to be applied to cleaning equipment. The first flow channel 110*a* of the wastewater tank 110 divides the fluid stream flowing into the wastewater tank 110 into multiple fluid steams and makes the air in the multiple fluid streams collide with each other in the wastewater tank 110. After the air-incorporated sewage and garbage is divided into multiple fluid steams through the first flow channel 110*a*, each fluid stream of the air-incorporated sewage and garbage undergoes an air-liquid separation process during the downward flow into the wastewater tank 110. During the air-liquid separation process, every fluid stream of the air-incorporated sewage and garbage collides with each other in the wastewater tank 110, so that the kinetic energy of each fluid stream of the air-incorporated sewage and garbage is reduced, cancelled out, or at least cancelled out in part due to the above collisions. Therefore, the sewage and garbage is able to flow into the wastewater tank 110 more smoothly and fluently. The separated air collides with the air of other fluid streams in the wastewater tank structure 100, thus reducing its own kinetic energy, enabling the suction producing device 300 to more easily suck the separated air away through the second flow channel 110*b* to prevent the separated air from continuing to fall down and mix with sewage and garbage to agitate the sewage and garbage, which can effectively prevent the sewage and garbage in the wastewater tank 110 from being sucked into the suction producing device 300. The above implementation not only prevents damage to the suction producing device 300, but also prevents the sewage and garbage from being blown to the outside of the cleaning equipment. Compared with conventional designs, in general, which emphasize power by increasing the flow energy of rotating air, the present embodiment reduces the kinetic energy of the disturbed fluid stream in the wastewater tank structure 100, so that the sewage and garbage in the wastewater tank structure 100 are not easily sucked into the suction producing device 300, thereby reducing the probability of damage to the suction producing device 300.

Another embodiment of the present disclosure provides cleaning equipment. The cleaning equipment includes the machine body 200 and the wastewater tank structure 100 of the above-described embodiments disposed on the machine body 200. As an example, the cleaning equipment can be a wet vacuum cleaner.

As an example, the wastewater tank structure 100 and the machine body 200 are connected by an engagement structure. As shown in FIG. 2, the engagement structure includes a snap jointer 130 (i.e., a fastener), a spring 140, and a snap slot (not shown). The snap jointer 130 is connected with the tank cover 112 of the wastewater tank structure 100 by the spring 140, and the snap slot is disposed in a portion of the machine body 200 corresponding to the snap jointer 130. The combination between the snap jointer 130 and the snap slot realizes the characteristics of stable connection and easy disassembly. Therefore, the wastewater tank structure 100 and the machine body 200 are detachable. When the wastewater tank structure 100 needs to be cleaned, the wastewater tank structure 100 can be removed from the machine body 200 for cleaning, which realizes the characteristics of easy disassembly and easy installation. In some embodiments, a handle 150 is provided on an outer wall of the tank body 111, and the handle 150 is convenient to push and pull the wastewater tank structure 100 and facilitates the disassembly and assembly of the wastewater tank structure 100.

The wastewater tank structure 100 described above is able to be applied to cleaning equipment. The first flow channel 110*a* of the wastewater tank 110 divides the fluid stream flowing into the wastewater tank 110 into multiple fluid streams and makes the air in the multiple fluid streams collide with each other in the wastewater tank 110. After the air-incorporated sewage and garbage is divided into multiple fluid steams through the first flow channel 110*a*, each fluid stream of the air-incorporated sewage and garbage undergoes an air-liquid separation process during the downward flow into the wastewater tank 110. During the air-liquid separation process, every fluid stream of the air-incorporated sewage and garbage collides with each other in the wastewater tank 110, so that the kinetic energy of each fluid stream of the air-incorporated sewage and garbage is reduced, cancelled out, or at least cancelled out in part due to the above collisions. Therefore, the sewage and garbage is able to flow into the wastewater tank 110 more smoothly and fluently. The separated air collides with the air of other fluid streams in the wastewater tank structure 100, thus reducing its own kinetic energy, enabling the suction producing device 300 to more easily suck the separated air away through the second flow channel 110*b* to prevent the separated air from continuing to fall down and mix with sewage and garbage to agitate the sewage and garbage, which can effectively prevent the sewage and garbage in the wastewater tank 110 from being sucked into the suction producing device 300. The above implementation not only prevents damage to the suction producing device 300, but also prevents the sewage and garbage from being blown to the outside of the cleaning equipment. Compared with conventional designs, in general, which emphasize power by increasing the flow energy of rotating air, the present embodiment reduces the kinetic energy of the disturbed fluid stream in the wastewater tank structure 100, so that the sewage and garbage in the wastewater tank structure 100 are not easily sucked into the suction producing device 300, thereby reducing the probability of damage to the suction producing device 300.

Further, in one embodiment of the present disclosure, the cleaning equipment further includes the suction producing device 300 disposed on the machine body 200, the floor brush 400, and the connecting pipe 500. The first terminal and the second terminal, defined on the connecting pipe 500. The first terminal is configured to connect to the floor brush 400, and the second terminal is configured to connect to the inlet of the first flow channel 110*a*. A suction opening of the suction producing device 300 is connected to the outlet of the second flow channel 110*b* of the wastewater tank 110. Under the suction force of the suction producing device 300, the air-incorporated sewage and garbage obtained after scrubbing by the floor brush 400 is moved along through the connecting pipe 500 to enter into the accommodation cavity of the wastewater tank 110 through the first flow channel 110*a*. The separated air is discharged from the wastewater tank structure 100 through the second flow channel 100*b* and exhausted to the external environment by the suction producing device 300.

In some embodiments, the cleaning equipment includes a power source 700 configured in the machine body 200. The power source 700 supplies power to the floor brush 400 and the suction producing device 300. It should be noted that in other embodiments, the cleaning equipment can also be powered by commercial power directly, which is not particularly limited here. Furthermore, a container is defined in the machine body 200, and the power source 700 and the suction producing device 300 are contained in the container.

In some embodiments, the suction producing device 300 is located on the upper side of the second flow channel 110*b*, and the suction opening of the suction producing device 300 is disposed corresponding to the outlet of the second flow channel 110*b*. Therefore, it is beneficial for the suction producing device 300 to suck out the air in the wastewater tank 110. A hollow or mesh structure is formed at a bottom end of the machine body 200 at a position corresponding to the outlet of the second flow channel 110*b*. In addition, the machine body 200 is provided with an air outlet connected with the accommodation cavity.

In some embodiments, as shown in the FIG. 5, a first sealing member 610 is disposed at a first connecting portion located between the wastewater tank structure 100 and the second terminal of the connecting pipe 500, and the first sealing member 610 circles around the inlet of the first flow channel 110*a*. Due to the arrangement of the first sealing member 610, the sealing performance of the connection between the connecting pipe 500 and the wastewater tank structure 100 is improved so as to inhibit the air contained in the sewage and garbage from flowing out from the connection between the connecting pipe 500 and the wastewater tank structure 100. The first sealing member 610 can be arranged at a mouth of a second end of the connecting pipe 500 or on the stand 121 of the filter assembly 120. The first sealing member 610 can be a rubber ring, which can be fixed by a bonding process.

In some embodiments, as shown in the FIG. 5, a second sealing member 620 is disposed at a second connecting portion located between the wastewater tank structure 100 and the machine body 200, and the second sealing member 620 circles around the outlet of the second flow channel 110*b*. The second sealing member 620 can be arranged on the stand 121 of the filter assembly 120 or on the machine body 200. Due to the arrangement of the second sealing member 620, the sealing performance of the connection between the outlet of the second flow channel 110*b* and the machine body 200 is able to be improved so as to avoid affecting the suction effect of the suction producing device 300.

In some embodiments, the cleaning equipment further includes a clean water tank 800. The clean water tank 800 is disposed on the machine body 200. The clean water tank 800 is connected with the floor brush 400 by a water pipe so as to deliver water to the floor brush 400 to provide water for brushing the floor.

In some embodiments, the cleaning equipment further includes a handle 900. The handle 900 is disposed on a top end of the machine body 200 and used held during cleaning to improve the comfort of use.

In some embodiments, the cleaning equipment further includes a power button. The power button is disposed on the handle. The power button is electrically connected with the power source 700, which is used to control the working status of the cleaning equipment.

An embodiment of the present disclosure provides a wastewater tank structure 100. As shown in FIG. 1 and FIG. 2, the wastewater tank structure 100 includes the tank body 111 and the tank cover assembly 2. The tank cover assembly 2 is disposed on a top end of the tank body 111.

Specifically as shown in FIG. 1 and FIG. 2, the tank body 111 has the accommodation cavity therein. It can be understood that the tank body 111 can specifically be in the shape of a cup, no other structures are present in the accommodation cavity of the tank body 111, and an inner wall of the accommodation cavity is smooth and rounded so as to facilitate rinsing. In addition, an end (specifically the top end) of the tank body 111 is formed with an opening in communication with the accommodation cavity. The tank cover assembly 2 includes the tank cover 112 and the first flow channel 110*a*. The tank cover 112 is disposed on an end (specifically the top end) of the tank body 111 proximate to the opening 12. It can be understood that the tank cover 112 of the tank cover assembly 2 covers the tank body 111 such that a sealed space is formed in the tank body 111. The tank cover 112 can specifically be detachable relative to the tank body 111, such that the tank body 111 can be detached therefrom and cleaned. The first flow channel 110*a* is in communication with the tank cover 112 and the accommodation cavity. A terminal end of the first flow channel 110*a* is provided with an even number of dividing outlets 110*c*.

A fluid stream flowing in through the first flow channel 110*a* is divided into the same number of fluid streams as the number of the dividing outlets 110*c*, and a plurality of fluid streams are formed into pairs, in which the plurality of fluid streams form into pairs having equal kinetic energies carried thereby. It should be noted that the statement "the plurality of fluid streams form into pairs having equal kinetic energies carried thereby" means the plurality of fluid streams form into pairs having completely equal or substantially equal kinetic energies carried thereby.

It can be understood that the operating principle of the wastewater tank structure 100 is substantially as follows. When subject to suction, a fluid stream such as air-incorporated sewage and garbage enters the tank cover 112, then flows through the first flow channel 110*a* and collides with an inner tube wall of the first flow channel 110*a* such that the air-incorporated sewage and garbage are divided in the first flow channel 110*a* and are divided by the dividing outlets 110*c* into the same number of fluid streams as the number of the dividing outlets 110*c*, and a plurality of fluid streams are formed into pairs. The plurality of fluid streams flow into the accommodation cavity and collide with each other such that the air-incorporated sewage and garbage is separated therefrom. The sewage and garage, subject to the inertial effect caused by gravity, enter the bottom of the accommodation cavity of the tank body 111, and the separated air is discharged to an external environment.

In summary, compared with the prior art, the wastewater tank structure 100 has at least the following benefits. In the wastewater tank structure 100, the first flow channel 110*a* is disposed on the tank cover 112 covering the tank body 111 such that the fluid stream, such as the air-incorporated sewage and garbage, can flow through the first flow channel 110*a* into the accommodation cavity of the tank body 111, and the air is separated from the sewage and garbage and discharged to the external environment. In addition, the first flow channel 110*a* is disposed on the tank cover 112 of the tank cover assembly 2, thereby simplifying the internal structure of the tank body 111, reducing occupied space, and facilitating cleaning. In addition, when subject to suction, a fluid stream such as the air-incorporated sewage and garbage flows from the tank cover 112 through the first flow channel 110*a* and is divided by the dividing outlets 110*c* of the first flow channel 110*a* into the same number of fluid streams as the number of the dividing outlets 110*c*, and a plurality of fluid streams are formed into pairs. The plurality of fluid streams flow into the accommodation cavity and collide with each other to generate opposing cyclone air streams colliding with each other such that an interaction between kinetic energy of the air and kinetic energy of the sewage and garbage in the tank body 111 is suppressed, and fluctuation of the liquid level in the accommodation cavity of the tank body 111 is suppressed, thereby effectively preventing the sewage and garbage from being blown away by the air into a motor or into the external environment and increasing the degree of separation of the air from the sewage and garbage. In summary, the wastewater tank structure 100 has a simple structure and large storage space, can be easily cleaned, and there is a high degree of separation of air from sewage and garbage.

In order to enable those skilled in the art to better understand the solutions of the present disclosure, the technical solutions in the embodiments of the present disclosure will be described below with reference to the drawings.

In some embodiments, the tank cover assembly 2 further includes the second flow channel 110*b*, and the second flow channel 110*b* is in communication with the tank cover 112 and the accommodation cavity.

The plurality of fluid streams collide with each other in the accommodation cavity such that air incorporated therein is separated from the sewage and garbage, and the separated air is capable of flowing to the outside through the second flow channel 110*b*. It can be understood that the second flow channel 110*b* is disposed on the tank cover 112 of the tank cover assembly 2, thereby simplifying the internal structure of the tank body 111, reducing occupied space, and facilitating cleaning. In addition, the plurality of fluid streams flow into the accommodation cavity and collide with each other such that the air incorporated sewage therein is separated from the sewage and garbage. The sewage and garbage, subject to the inertial effect caused by gravity, enter the bottom of the accommodation cavity of the tank body 111, and the air can be smoothly discharged to an external environment by means of the second flow channel 110*b*.

In some embodiments as shown in FIG. 2, all of the dividing outlets 110*c* of the first flow channel 110*a* are directed towards the side wall of the tank body 111. It can be understood that when subject to suction, a fluid stream such as the air-incorporated sewage and garbage flows from the tank cover 112 into the first flow channel 110*a*, and when subject to the suction and the inertial effect caused by gravity of the sewage and garbage, the sewage and garbage entering the first flow channel 110*a* is divided into the same number of fluid streams as the number of the dividing outlets 110*c* when colliding with the inner tube wall of the first flow channel 110*a*, and a plurality of fluid streams are formed into pairs and flow through corresponding dividing outlets 110*c* respectively into the accommodation cavity. After entering the accommodation cavity, the plurality of fluid streams all hit the side wall of the tank body 111 and then change directions again to generate opposing cyclone air streams colliding with each other such that an interaction between kinetic energy of the air and kinetic energy of the sewage and garbage in the tank body 111 is suppressed, and fluctuation of the liquid level in the accommodation cavity of the tank body 111 is suppressed, thereby effectively preventing the sewage and garbage from being blown away by the air into a motor or into the external environment and increasing the degree of separation of the air from the sewage and garbage.

In some embodiments, an inlet of the second flow channel 110*b* is directed towards the side wall of the tank body 111 so as to better prevent surges in the tank body 111 from entering the inlet of the second flow channel 110*b*, thereby further increasing the utilization rate of storage space in the tank body 111. It should be noted that the inlet of the second flow channel 110*b* and the dividing outlets 110*c* of the first flow channel 110*a* are offset so as to prevent the fluid stream flowing out of the divdings outlets 110*c* of the first flow channel 110*a* from directly flowing out through the inlet of the second flow channel 110*b*.

In some embodiments as shown in FIG. 1 and FIG. 2, a top end surface of the tank cover 112 is sloped, the tank cover 112 includes a low end and a high end connected to the low end, and the second flow channel 110*b* is correspondingly disposed at the high end of the tank cover 112. It should be noted that the low end of the tank cover 112 refers to an end of the tank cover 112 where the distance between the top end surface of the tank cover 112 and the bottom of the tank body 111 is the shortest, and the high end of the tank cover 112 refers to an end of the tank cover 112 where the distance between the top end surface of the tank cover 112 and the bottom of the tank body 111 is the longest. It can be understood that in a cleaning process of a cleaning apparatus, such as the vacuum cleaner, the accommodation cavity of the tank body 111 is stored with sewage and garbage, such that movement of the vacuum cleaner causes sewage stored inside the tank body 111 to form surges. The second flow channel 110*b* is thus disposed at the high end of the tank cover 112 such that the inlet of the second flow channel 110*b* is located as far as possible away from the bottom of the tank body 111 in a limited space, and therefore the surges are prevented from entering the inlet of the second flow channel 110*b*, thereby further improving the utilization rate of the storage space of the tank body 111.

In some embodiments as shown in FIG. 2, the tank cover assembly 2 further includes the filter assembly 120, and the filter assembly 120 includes the stand 121 and the filter 122.

As shown in FIG. 1 and FIG. 2, at a position corresponding to the outlet of the second flow channel 110*b*, an end of the tank cover 112 away from the tank body 111 has a discharging cavity configured to cause the separated air to flow out, and the stand 121 is disposed on the tank cover 112. Specifically, the stand 121 and the tank cover 112 can be an integrally formed structure or separate structures, and the structure is not specifically limited herein. The hollow portion (not shown) is disposed on the stand 121, and the filter 122 is disposed on the hollow portion of the stand 121. It can be understood that the stand 121 is provided with the hollow portion at a position corresponding to the discharging cavity such that the stand 121 provided with the hollow portion can stably bear the filter 122 and also prevent the filter 122 from being detached from the stand 121. In addition, the position of the hollow portion relative to the discharging cavity enables the air flowing out of the second flow channel 110*b* to pass through the hollow portion of the stand 121, to be further filtered by the filter 122, and then to be discharged to the external environment. It can be understood that the air separated from the sewage and garbage is filtered again using the filter 122 after being discharged from the second flow channel 110*b*, thereby further purifying the air and effectively preventing the sewage and garbage carried in the air from being carried out by the air. It should be noted that in this embodiment, the filter 122 can be a sponge filter. The sponge filter is resilient, has high filtration efficiency and low resistance to air, and is repeatedly washable and cheap, and therefore the sponge filter is effective in filtering the air and reducing costs. In addition, in this embodiment, the filter 122 is semi-circular, and correspondingly the hollow portion of the stand 121 is also semi-circular.

On the basis of the aforementioned wastewater tank structure 100, an embodiment of the present disclosure further provides a vacuum cleaner. As shown in FIG. 3 to FIG. 5, the vacuum cleaner includes the machine body 200 and the aforementioned wastewater tank structure 100. The wastewater tank structure 100 is vertically detachably connected to the machine body 200. It should be noted that in this embodiment, the wastewater tank structure 100 is connected to the machine body 200 by means of an engagement structure. Specifically, the engagement structure includes the snap jointer 130, the spring 140, and an engagement recess (not shown). The snap jointer 130 is connected to the tank cover 112 using the spring 140. At a position corresponding to the snap jointer 130, the engagement recess is disposed on the machine body 200. The snap jointer 130 engages with and is connected to the engagement recess, thereby achieving a firm connection and facilitating detachment. It can be understood that the wastewater tank structure 100 is detachably connected to the machine body 200, and when the wastewater tank structure 100 needs to be cleaned, the wastewater tank structure 100 is detached from the machine body 200 for cleaning, thereby achieving easy detachment and mounting.

In summary, compared with the prior art, the vacuum cleaner has at least the following benefits. In the wastewater tank structure 100 used by the vacuum cleaner, the first flow channel 110*a* is disposed on the tank cover 112 covering the tank body 111 such that the fluid stream, such as the air-incorporated sewage and garbage, can flow through the first flow channel 110*a* into the accommodation cavity of the tank body 111, and the air is separated from the sewage and garbage and discharged to the external environment. In addition, the first flow channel 110*a* is disposed on the tank cover 112 of the tank cover assembly 2, thereby simplifying the internal structure of the tank body 111, reducing occupied space, and facilitating cleaning. In addition, when subject to suction, a fluid stream, such as the air-incorporated sewage and garbage, flows from the tank cover 112 through the first flow channel 110*a* and is divided by the dividing outlets 110*c* of the first flow channel 110*a* into the same number of fluid streams as the number of the dividing outlets 110*c*, and a plurality of fluid streams are formed into pairs. The plurality of fluid streams flow into the accommodation cavity and collide with each other to generate opposing cyclone air streams colliding with each other such that an interaction between kinetic energy of the air and kinetic energy of the sewage and garbage in the tank body 111 is suppressed, and fluctuation of the liquid level in the accommodation cavity of the tank body 111 is suppressed, thereby effectively preventing the sewage and garbage from being blown away by the air into a motor or to the external environment and increasing the degree of separation of the air from the sewage and garbage. In summary, the vacuum cleaner has a simple structure and large storage space, can be easily cleaned, and there is a high degree of separation of air from sewage and garbage.

In some embodiments as shown in FIG. 3 and FIG. 4, the vacuum cleaner further includes the floor brush 400, the connecting pipe 500, and the suction producing device 300. The floor brush 400, the wastewater tank structure 100, and the suction producing device 300 are sequentially mounted on the machine body 200 from bottom to top. The floor brush 400 is configured to scrub a floor. The wastewater tank structure 100 is configured to store sewage and garbage collected after floor scrubbing. The suction producing device 300 is configured to produce suction such that the air-incorporated sewage and garbage collected after floor scrubbing by the floor brush 400 enters the wastewater tank structure 100 and flows out therefrom. It should be noted that the machine body 200 has a container cavity (not shown) therein. The suction producing device 300 and a power source 700 are both accommodated in the container cavity, and a suction port of the suction producing device 300 is aligned with the bottom end of the machine body 200. At a position corresponding to the outlet of the second flow channel 110*b*, the bottom end of the machine body 200 defines a hollow structure or a mesh structure, and the machine body 200 is provided with an air outlet in communication with the container cavity. The connecting pipe 500 includes a first end and a second end opposing and connected to the first end, i.e., two opposite ends of the connecting pipe 500. The first end of the connecting pipe 500 is connected to the floor brush 400. The second end of the connecting pipe 500 is connected to the tank cover assembly 2 of the wastewater tank structure 100. The second end of the connecting pipe 500 is configured to be in communication with the inlet of the first flow channel 110*a*. When subject to suction produced by the suction producing device 300, air-incorporated sewage and garbage collected after floor scrubbing by the floor brush 400 flows along the connecting pipe 500 and through the first flow channel 110*a* and enters the accommodation cavity of the tank body 111 to form fluid streams colliding with each other, such that air is separated from the sewage and garbage, rises to an upper portion of the accommodation cavity, is discharged from the wastewater tank structure 100 through the second flow channel 110*b*, then enters the container cavity and flows out through the air outlet.

In some embodiments as shown in FIG. 1 and FIG. 2, in order to improve the compactness of the structure, an edge of the tank body 111 is recessed in the lengthwise direction of the machine body 200 towards a central axis of the tank body 111 to form a recess for accommodating the connecting pipe 500, such that the connecting pipe 500 can be fit to the tank body 111 and extend into the tank body 111 from the top end thereof.

In some embodiments as shown in FIG. 4, the vacuum cleaner further includes the power source 700. The power source 700 is disposed in the machine body 200. The power source 700 is configured to supply power to the floor brush 400 and the suction producing device 300. It should be noted that in other embodiments, the vacuum cleaner can also be powered by main power, which is not specifically limited herein.

In some embodiments as shown in FIG. 5, the vacuum cleaner further includes the first seal member 610. The first seal member 610 is disposed at a connection point of the connecting pipe 500 and the tank cover assembly 2. It should be noted that the first seal member 610 can be specifically disposed at a tube opening of the connecting pipe 500 or on the tank cover assembly 2. It can be understood that the first seal member 610 improves sealing at the connection point of the connecting pipe 500 and the tank cover assembly 2, thereby preventing the air-incorporated sewage and garbage from flowing out from the connection point of the connecting pipe 500 and the tank cover assembly 2.

In some embodiments as shown in FIG. 5, the vacuum cleaner further includes the second seal member 620. At a position at the outlet of the second flow channel 110*b*, the second seal member 620 is disposed at a connection point of the wastewater tank structure 100 and the machine body 200. It should be noted that the second seal member 620 can be specifically disposed at the outlet of the second flow channel 110*b* or on the machine body 200. It can be understood that the second seal member 620 can improve sealing at the connection point of the outlet of the second flow channel 110*b* of the wastewater tank structure 100 and the machine body 200, thereby preventing the suction effect of the suction producing device 300 from being affected.

In some embodiments as shown in FIG. 3, the vacuum cleaner further includes the clean water tank 800. The clean water tank 800 is disposed on the machine body 200. The clean water tank 800 is connected to the floor brush 400 by means of a water tube so as to spray water to the floor brush 400 and provide a water source for scrubbing the floor.

In some embodiments as shown in FIG. 3, the vacuum cleaner further includes the handle 900. The handle 900 is disposed at the top end of the machine body 200 so as to facilitate gripping during cleaning, thereby improving use comfort.

In some embodiments as shown in FIG. 3, the vacuum cleaner further includes a power button. The power button is disposed on the handle 900. The power button is electrically connected to the power source 700 so as to control an operating state of the vacuum cleaner.

The above descriptions are merely the preferred embodiments of the present disclosure and are not intended to limit the present disclosure. For those skilled in the art, the present disclosure may have various alterations and changes. Any modifications, equivalent substitutions, improvements, and the like made within the spirit and principle of the present disclosure shall fall within the scope of the claims of the present disclosure.

What is claimed is:

1. A wastewater tank structure for cleaning equipment, comprising:

a wastewater tank; and a first flow channel and a second flow channel, provided with the wastewater tank, both connecting through an inside portion and an outside portion of the wastewater tank, wherein:

the first flow channel divides a fluid stream flowing to the wastewater tank into multiple fluid streams to make the multiple fluid streams collide in the wastewater tank, and the second flow channel discharges air in the wastewater tank.

2. The wastewater tank structure according to claim 1, wherein the first flow channel defines at least two dividing outlets distributed at intervals.

3. The wastewater tank structure according to claim 1, wherein:

the wastewater tank comprises a tank body and a tank cover, the tank body defines an accommodation cavity and a first opening at one terminal of the tank body connecting with the accommodation cavity, the tank cover is disposed at another terminal of the tank body close to the first opening, and the first flow channel and the second flow channel are provided on an end portion of the tank body close to the first opening or on the tank cover.

4. The wastewater tank structure according to claim 3, wherein:

the first flow channel defines at least two dividing outlets, and the at least two dividing outlets of the first flow channel are distributed towards a side wall of the tank body.

5. The wastewater tank structure according to claim 3, wherein an inlet of the second flow channel is distributed towards a side wall of the tank body.

6. The wastewater tank structure according to claim 3, wherein:

the first flow channel defines at least two dividing outlets, and a first distance between an inlet of the second flow channel and a bottom of the accommodation cavity is longer than a second distance between the at least two dividing outlets of the first flow channel and the bottom of the accommodation cavity.

7. The wastewater tank structure according to claim 6, wherein:

a side wall of the tank cover close to the bottom of the accommodation cavity is an inclined plane with a high portion and a low portion, and the second flow channel is disposed at the high portion and the first flow channel is disposed at the low portion.

8. The wastewater tank structure according to claim 3, wherein:

the first flow channel defines at least two dividing outlets, and an inlet of the second flow channel and the at least two dividing outlets of the first flow channel are staggered.

9. The wastewater tank structure according to claim 8, wherein:

the tank cover defines a second opening and a third opening, a dividing portion protruding toward an inside of the accommodation cavity and an exhausting portion are both disposed on the tank cover, the first flow channel is opened at the dividing portion and connected with the second opening, and the second flow channel is opened at the exhausting portion and connected with the third opening.

10. The wastewater tank structure according to claim 9, wherein:

the exhausting portion and the dividing portion are distributed at two side of an axis of the tank body, and the inlet of the second flow channel is opened at a wall of the exhausting portion away from the dividing portion and towards a direction different from a direction of the at least two dividing outlets of the first flow channel.

11. The wastewater tank structure according to claim 9, wherein:

the dividing portion comprises a baffle disposed at a bottom of the second opening, the first flow channel is defined between the baffle and the second opening, and at least one terminal of the baffle is connected with the tank cover or the exhausting portion.

12. The wastewater tank structure according to claim 11, wherein one terminal of the baffle extends in a direction away from the inlet of the second flow channel.

13. The wastewater tank structure according to claim 12, wherein:

the one terminal of the baffle bends and protrudes towards the second opening, the baffle is bent about an axis, and the at least two dividing outlets of the first flow channel are opened at one end of the dividing portion distributed from one end of the baffle to another end of the baffle.

14. The wastewater tank structure according to claim 9, wherein:

the exhausting portion is configured as a shell structure, and an inner chamber of the exhausting portion defines the second flow channel and covers the third opening.

15. The wastewater tank structure according to claim 9, wherein an inner wall of the tank body is flat.

16. The wastewater tank structure according to claim 15, wherein the wastewater tank structure comprises a filter assembly disposed on the wastewater tank for filtering the air exhausted from an outlet of the second flow channel.

17. The wastewater tank structure according to claim 16, wherein:

an outflow chamber corresponding to the outlet of the second flow channel is defined on the wastewater tank, the filter assembly comprises a stand and a filter, the stand is disposed on the wastewater tank and defines a hollow portion corresponding to the outflow chamber, and the filter is disposed on the hollow portion.

18. The wastewater tank structure according to claim 15, wherein an outer wall of the wastewater tank defines a container for containing a connecting pipe of the cleaning equipment.

19. The cleaning equipment, comprising a machine body and the wastewater tank structure of claim 1 disposed on the machine body.

20. The cleaning equipment according to claim 19, wherein:

the cleaning equipment further comprises a suction producing device disposed on the machine body, a floor brush, and a connecting pipe, a first terminal and a second terminal are defined at the connecting pipe, the first terminal connects to the floor brush, the second terminal connects to an inlet of the first flow channel, and a suction opening of the suction producing device connects through an outlet of the second flow channel of the wastewater tank.

21. The cleaning equipment according to claim 20, wherein:

the suction producing device is located at an upper side of the second flow channel, and the suction opening of the suction producing device is disposed corresponding to the outlet of the second flow channel.

22. The cleaning equipment according to claim 21, wherein:

a first sealing member is disposed at a first connecting portion located between the wastewater tank structure and the second terminal of the connecting pipe, and the first sealing member circles around the inlet of the first flow channel.

23. The cleaning equipment according to claim 20, wherein:

a second sealing member is disposed at a second connecting portion located between the wastewater tank structure and the machine body, and the second sealing member circles around the outlet of the second flow channel.

* * * * *